United States Patent [19]

Smith

[11] 4,283,801

[45] Aug. 18, 1981

[54] HYDRAULIC CYLINDER FOR MULTILEVEL SUBMERSIBLE SAFETY DECK OR DECKS FOR POOLS

[76] Inventor: Francis C. Smith, 9 Glenview Rd., Strathmore, Victoria 3041, Australia

[21] Appl. No.: 881,545

[22] Filed: Feb. 27, 1978

[30] Foreign Application Priority Data

Mar. 8, 1977 [AU] Australia ..... 9320/77

[51] Int. Cl.[3] ..... E04H 3/16

[52] U.S. Cl. ..... 4/496; 4/495

[58] Field of Search ..... 4/172.1, 172.11, 172.12, 4/172.13, 172.14; 52/169.7

[56] References Cited

U.S. PATENT DOCUMENTS

| | | | |
|---|---|---|---|
| 3,045,253 | 7/1962 | Price | 4/172.13 |
| 3,046,566 | 7/1962 | Berman | 4/172.13 |
| 3,086,219 | 4/1963 | Stafford | 4/172.13 |
| 3,553,743 | 1/1971 | Lodige | 4/172.13 |
| 3,668,711 | 6/1972 | Liermann | 4/172.13 |
| 3,670,343 | 6/1972 | Gansloser | 4/172.13 |

*Primary Examiner*—John E. Murtagh

[57] ABSTRACT

Pools of all peripheral shapes of either above or below ground construction with single slope or flat bottoms when not in use may be equipped with a rigid structurally safe traversible completely dry surface deck or decks for domestic functions and to simultaneously insulate the surface of the water with which it is in contact but when pool is in use such a deck or decks are to be readily set at any depth in the pool until it or they become finally a false bottom by means of control by external low pressure hydraulic cylinders operated from the pool circulating system per medium of a single readily operable but safety positioned three-way valve.

2 Claims, 4 Drawing Figures

HYDRAULIC CYLINDER FOR MULTILEVEL SUBMERSIBLE SAFETY DECK OR DECKS FOR POOLS

PRIOR ART

A number of safety pool covers such as the spirally wound arrangement of horizontal transverse parallel rectangular aluminium tubes may be supported when unwound over a rectangular shaped pool by parallel side ledges at right angles to the length of the linked assembly of tubes with the winding up or running out of the spiral assembly all above water surface level to provide a structural traversible deck at the one only fixed level.

Other reinforced plastic foldable sheet tie-on covers of a non-structural non-traversible and sagging type are available and in some cases these are blister formed similar to a sandwich to provide an insulation to the surface. Also considerable time and much labour is required to fit the cover effectively. A variation to this type of cover is a non-corrosive wire mesh roll up cover but this allows the entry of debris and also requires mechanical or multi-person labour to secure and is non-traversible.

BRIEF SUMMARY OF INVENTION

With this invention a rigid structurally safe traversible dry surface deck or decks for pools may be set readily at any desired operating depth or to a maximum depth resting on the pool's bottom. This provides scope for use of one, two or more depths simultaneously and complete safety when the surfaces of the deck or decks are raised per medium of low-pressure hydraulic cylinders to above pool water surface and this also reduces the entry of debris and ensures safety for traversing by personnel and provides an insulating blanket. A number of fine grates are set into the concrete deck or decks for ready through-flow of water and for occasional removal for suction broom cleaning of bottom of pool. The low pressure hydraulic cylinders are external to the pool periphery and approximately flush with pool wall height. For lightly structured walls of above-ground pools the cylinders are free-standing and do not make contact with the pool structure. For both above or below ground pools the cylinder operate in a novel manner with an inverted reaction through the use of circular flexible plastic-coated galvanised wire rope sealed with "O" rings as the transfer medium of the applied hydraulic force within the cylinders. For below-ground pools the cylinder cap is structurally supported by the in-ground pool wall.

The deck or decks are of waffle type construction of scoria concrete or resin coated pumice aggregate lightweight concrete mesh reinforced and non-absorbent formed to pool shape with required clearance from the pool walls. When the surface area of the deck is divided into two or more decks which are intended for shallow and deep ends a neoprene fabric or similar may be attached to the adjacent edge of the intended lower deck at the division near to the top of the pool wall at both sides but passing through a slot or transverse bar which may be attached at each end to ends of the upper deck width. The cylinders for this upper or shallow end may, if desired, have correspondingly shortened strokes. Around the peripheral edge of the deck is bonded a soft rubber strip to rub on the inner wall of the pool to eliminate transverse shudder and in proper sequence all concrete components are treated anti-chlorine-attack surface coatings.

BRIEF DESCRIPTION OF VIEWS OF DRAWING

DESCRIPTION

Figure 1:
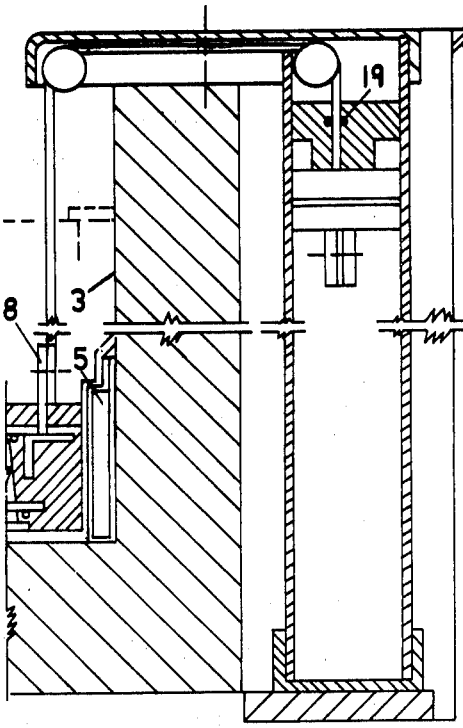
FIG. 1 shows part section of concrete wall and bottom of in-ground pool with external hydraulic cylinder and wire rope over pulleys supported by cylinder cap resting on top of wall.
Figure 2:
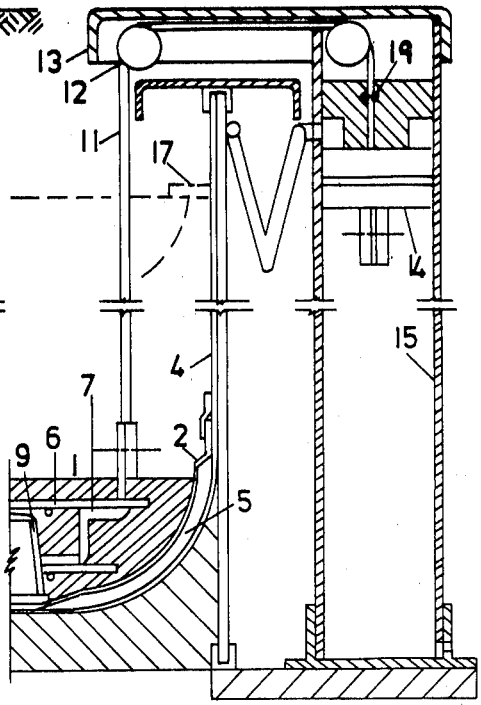
FIG. 2 shows part section of light gauge metallic wall and bottom of above-ground pool with external free-standing hydraulic cylinder and wire rope over pulleys supported by cantilevered cylinder cap which is clear of the top of the pool wall.
Figure 3:
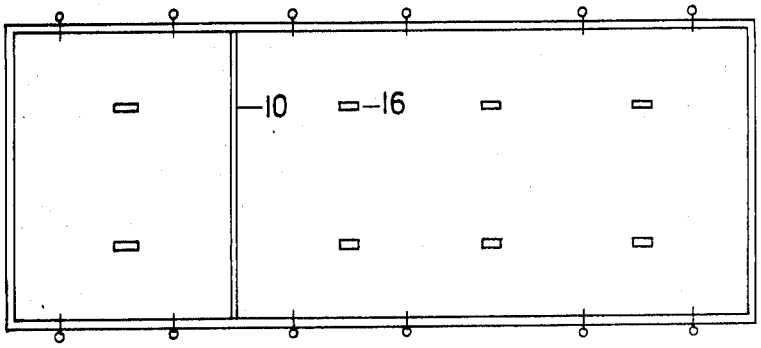
FIG. 3 shows a plan of a typical in-ground pool with appropriately positioned cylinders.
Figure 4:
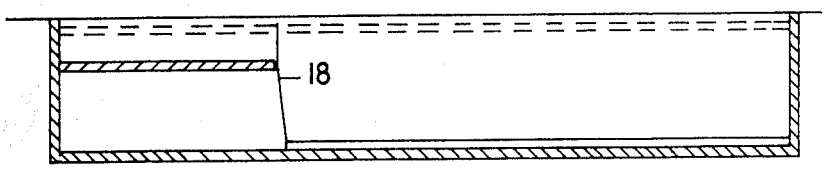
FIG. 4 shows section of a multilevel in-ground pool with selected depths.

Rigid structurally sufficient for safety reinforced light weight concrete submersible deck or decks are shown in views of pools in FIGS. 1, 2, 3 and 4. The deck part 1 is formed inside a flexible formwork of an additional bottom non-removable heavy polyethylene sheeting part 2 which is temporarily taped to either directly to the wall part 3 of an in-ground pool FIG. 1 or to the wall liner part 4 of an above-ground pool FIG. 2. Before taping to either a temporary removable spacer part 5 is set around the wall to be covered by the boxing sheeting part 2. Square reinforcing mesh of galvanised steel rods part 6 are set inside the shape of the bottom of pool formwork part 2 with short spacer galvanised angle iron spreaders part 7 with lifting attachment lugs part 8 and the bottom mesh is supported by chairs (not shown). Inside the squares of the reinforcing mesh are positioned smaller correctly sized air-filled and sealed standard and available plastic punnets part 9. These are bonded to the bottom boxing sheeting part 2 to form the waffle concrete deck with a local pre-soaked scoria aggregate or without the punnets part 9 when a light foam resin sealed pumice is used for the aggregate. In each case the total resultant concrete density of the impervious poured deck is designed to be by this novel application only slightly but permanently higher than the pool water in which it is to be immersed because of the content of entrapped air which also provides a significant insulating factor when deck is on the surface. In each case the concrete deck or decks if separated by a removable division boxing part 10 or in one slab are lifted or lowered through lugs part 8 by standard and available plastic flexible coated round galvanised wires part 11 which would be guided by nylon pulleys part 12 through support from aluminum cylinder cap part 13 to be central to cylinder to attach to aluminum piston part 14 in galvanised steel or UPVC cylinder part 15 which has a predetermined stroke to ensure that the top surface of the deck is sufficiently above the pool water surface that when under full-live-load-deflection the deck remains dry. Nevertheless the deck or decks may be suspended at any lower but selected level and traversed upon by ready adjustment of the cylinder stroke by application or release of the hydraulic supply through valve or valves (not shown) which may be of a type operated by key only. A number of fine grates part 16 are set into the concrete deck or decks for pool water up or down flow and also for removal when required for cleaning bottom of pool. The grate openings when uncovered are too small for a child to pass through. When two or more depths are required a neoprene curtain fabric (or similar) part 18 is attached to top of pool at dry deck level at both sides and the transverse edge of the intended lower deck but passing through a transverse slotted bar or galvanised angle (not shown) attached to the intended upper deck edge. Around the outer periphery of the deck or decks is bonded a soft rubber strip part 17 when the temporary boxing part 5 is removed.

I claim:

1. In either an in or above ground pool provided with walls including single acting low pressure hydraulic cylinders externally and stationary positioned relative to and approximately flush with the head and base of said walls which can be used to control the level of a rigid traversible deck or decks in said pool with an inverted reaction through the novel use of a circular flexible plastic-coated wire rope sealed with "O" rings as the transfer medium of the applied hydraulic force within the cylinders and said plastic-coated rope is guided by pulleys supported by an extended arm on cylinder caps provided over the wall to connect to the decks and this extended arm can be clear of the wall when such a condition is required.

2. Single acting hydraulic cylinders referred to in claim 1 can be operated through one three way valve using the low pressure circulating water as is associted with all pools for the normal filter system.

* * * * *